US006190574B1

(12) United States Patent
Nakagawa et al.

(10) Patent No.: US 6,190,574 B1
(45) Date of Patent: Feb. 20, 2001

(54) PHOSPHORUS-COMPRISING LUBRICATING OIL COMPOSITION

(75) Inventors: Shoji Nakagawa; Yuichiro Kobayashi; Hiroyasu Togashi; Toshiya Hagihara; Koji Taira, all of Wakayama (JP)

(73) Assignee: Kao Corporation, Tokyo (JP)

( * ) Notice: Under 35 U.S.C. 154(b), the term of this patent shall be extended for 0 days.

(21) Appl. No.: 09/106,137

(22) Filed: Jun. 29, 1998

Related U.S. Application Data

(63) Continuation-in-part of application No. PCT/JP96/03868, filed on Dec. 26, 1996.

(30) Foreign Application Priority Data

Dec. 29, 1995 (JP) ..... 7-353545

(51) Int. Cl.[7] ..... C09K 5/00
(52) U.S. Cl. ..... 252/68; 508/427
(58) Field of Search ..... 508/427; 252/68

(56) References Cited

U.S. PATENT DOCUMENTS

| | | | | |
|---|---|---|---|---|
| 3,476,685 | * | 11/1969 | Oberender et al. | 508/427 |
| 4,118,330 | * | 10/1978 | Hotten | 508/427 |
| 5,405,546 | * | 4/1995 | Jolley et al. | 252/68 |
| 5,464,550 | * | 11/1995 | Sasaki et al. | 252/68 |
| 5,804,096 | * | 9/1998 | Sato et al. | 252/68 |

FOREIGN PATENT DOCUMENTS

| | | | |
|---|---|---|---|
| 53-124221 | * | 10/1978 | (JP) . |
| 53-130623 | * | 11/1978 | (JP) . |
| 59-10678 | | 3/1984 | (JP) . |
| 60-35352 | | 8/1985 | (JP) . |

OTHER PUBLICATIONS

Japanese Abstract: Phosphonate Ester Anti–Friction Additive for Fluids—Made by Reaction of Phosphite Diesters With Expoxides, JP57164192A, Oct. 8, 1982.

Japanese Abstract: Reaction Prod. of Vicinal Diol with Dihydrocarbyl Phosphite—is Useful as Friction–Reducing Additive in Lburicants and Fuels, JP60094988A, May 28, 1985.

Japanese Abstract: Lubricating Oil Compsn. for use in Refrigerator—Comprises Lubricating BAse Oil with Phosphonate Additive, JP5302093A, Nov. 16, 1993.

Japanese Abstract: Fluid Composition for Traction Drive, JP–A–62–10193–A, Jan. 19, 1987.

* cited by examiner

*Primary Examiner*—Necholus Ogden
(74) *Attorney, Agent, or Firm*—Birch, Stewart, Kolasch & Birch, LLP

(57) ABSTRACT

A lubricating oil composition including a phosphorus compound having two or more hydroxyl groups and a P—N bond in a molecule selected from the group consisting of compounds represented by the general formula (3), (4) or (5):

(3)

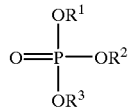

(4)

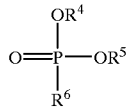

(5)

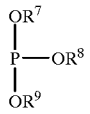

wherein $R^1$ to $R^5$ and $R^7$ to $R^9$, which may be identical or different, each represents an aryl group having 6 to 18 carbon atoms; a linear alkyl group having 1 to 18 carbon atoms; a branched alkyl group having 3 to 18 carbon atoms; a linear alkenyl group having 2 to 18 carbon atoms; or a branched alkenyl group having 3 to 18 carbon atoms; and $R^6$ represents hydrogen atom; a linear alkyl group having 1 to 18 carbon atoms; a branched alkyl group having 3 to 18 carbon atoms; a linear alkenyl group having 2 to 18 carbon atoms; or a branched alkenyl group having 3 to 18 carbon atoms; and a working fluid composition for refrigerating machine including the lubricating oil composition described above, and a hydrofluorocarbon.

12 Claims, No Drawings

PHOSPHORUS-COMPRISING LUBRICATING OIL COMPOSITION

This application is a continuation-in-part application of PCT/JP96/03686 filed on Dec. 26, 1996, the entire contents of which are incorporated herein by reference.

BACKGROUND OF THE INVENTION

1. Field of the Invention

The present invention relates to a lubricating oil composition comprising phosphorus compounds having a particular structure and having excellent lubricity. Further, it relates to a working fluid composition for refrigerating machines using the lubricating oil composition.

2. Discussion of the Related Art

With lengthened intervals of oil changes, need of energy-saving, use of high performance machines, and down-sizing of machines, demand for the performance of lubricating oils has become severe. In particular, lubricating oils with a high thermal stability and a high oxidation stability have been strongly sought. In the situation where there has been increasing public concern about global environmental pollution, such as depletion of ozone layer caused by flon, the earth warming due to carbon dioxide and methane, destruction of forests by sulfurous acid gas and $NO_x$ in exhaust fumes, and pollution of soil and lakes due to chemical leakage, environmental protective problems have been strongly sought also in the field of lubricating oils.

In order to meet the requirements for high thermal stability and oxidation stability, ethers, such as polyalkylene glycols, and esters, such as aliphatic diesters and hindered esters, have been developed.

In addition, from the viewpoint of the depletion of the ozone layer caused by flon, the refrigerant is changed from a chlorofluorocarbon (CFC) or a hydrochlorofluorocarbon (HCFC) to a hydrofluorocarbon (HFC). As to the refrigeration oil, a polyalkylene glycol, a hindered ester, or a carbonate, which is compatible with the hydrofluorocarbon, has been used.

However, since an oxygen-containing compound, including the ester, the polyalkylene glycol, the carbonate, or the like has a higher polarity than that of a hydrocarbon compound, including a mineral oil, or the like, the oxygen-containing compound has an excellent adsorptivity to metal surfaces. Therefore, there have been causing such problems that adsorption of such additives as oiliness improvers, antiwear additives, and extreme pressure additives is inhibited, thereby lowering the effects of these additives.

In particular, in a working fluid composition for refrigerating machines comprising an oxygen-containing compound, including a non-chlorine-containing HFC, an ester, or the like, since the lubricity improvement effects owing to hydrogen chloride generated by decomposition of CFC or HCFC, each containing a chlorine atom or chlorine atoms, cannot be expected, a further excelled lubricity is demanded in the refrigeration oil. However, there arises such a problem that triphosphates or triphosphites which have been conventionally used in refrigeration oils do not exhibit their effects in the oxygen-containing compounds.

In order to solve those problems, Japanese Patent Laid-Open Nos. 4-28792 and 4-100894 disclose the use of acid phosphoric esters and acid phosphorous esters. However, since those phosphorus compounds are acidic, there arise such problems that metals are rather corroded, and that hydrolysis of an ester or a carbonate, used as a base oil, is accelerated.

On the other hand, as to additives in the lubricant field, there have been proposed the use of neutral phosphoric esters containing hydroxyl groups. For instance, Japanese Patent Laid-Open No. 57-164192 discloses the use of a dialkyl 2-hydroxyalkyl phosphonate; Japanese Patent Laid-Open No. 60-94988 discloses the use of diester of phosphorous acid; Japanese Patent Laid-Open No. 5-302093 discloses the use of dioctyl hydroxymethylphosphonate; and Proceedings of JAST Tribology Conference (Tokyo, May, 1995), Japanese Society of Tribologists, discloses the use of a hydroxyalkyl phosphate. Each of those compounds has an alkyl chain having one hydroxyl group.

However, in the Proceedings of JAST Tribology Conference (Tokyo, May, 1995), Japanese Society of Tribologists, Minami et al. have reported that the phosphorus compound having an alkyl chain having one hydroxyl group is not effective in improving lubricity in a lubricating oil having high polarity, such as an ester oil (Proceedings 2A1-1).

Accordingly, it is an object of the present invention to provide a lubricating oil composition particularly having excellent lubricity even in the case where a base oil having a high polarity is used, and being free from metal corrosion by the additives.

Another object of the present invention is to provide a working fluid composition for a refrigerating machine containing the lubricating oil composition.

These and other objects of the present invention will be apparent from the following description.

SUMMARY OF THE INVENTION

The present invention pertains to the following:

(1) A lubricating oil composition comprising a phosphorus compound having two or more hydroxyl groups and a P—N bond in a molecule (simply abbreviated as "First Phosphorus Compound"), and one or more phosphorus compounds (simply abbreviated as "Second Phosphorus Compound") selected from the group consisting of compounds represented by the general formula (3), (4) or (5):

(3)

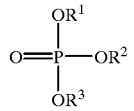

(4)

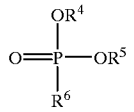

(5)

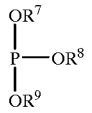

wherein $R^1$ to $R^5$ and $R^7$ to $R^9$, which may be identical or different, each represents an aryl group having 6 to 18 carbon atoms; a linear alkyl group having 1 to 18 carbon atoms; a branched alkyl group having 3 to 18 carbon atoms; a linear alkenyl group having 2 to 18 carbon atoms; or a branched alkenyl group having 3 to 18 carbon atoms; and $R^6$ represents hydrogen atom; a linear alkyl group having 1 to 18 carbon atoms; a branched alkyl group having 3 to 18 carbon atoms; a linear alkenyl group having 2 to 18 carbon atoms; or a branched alkenyl group having 3 to 18 carbon atoms;

(2) The lubricating oil composition described in item (1) above, wherein First Phosphorus Compound is represented by the general formula (1) or (2):

(1)

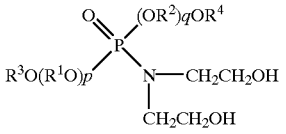

(2)

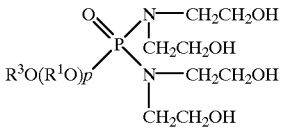

wherein $R^1$ and $R^2$, which may be identical or different, each represents a linear or branched alkylene group having 2 to 4 carbon atoms; p and q are from 0 to 30; and $R^3$ and $R^4$, which may be identical or different, each represents hydrogen atom; a linear alkyl group having 1 to 30 carbon atoms; a branched alkyl group having 3 to 30 carbon atoms; a linear alkenyl group having 2 to 30 carbon atoms; a branched alkenyl group having 3 to 30 carbon atoms; an aryl group having 6 to 30 carbon atoms; an aralkyl group having 7 to 30 carbon atoms; a halogenated alkyl group having 1 to 30 carbon atoms; or a halogenated aryl group having 6 to 30 carbon atoms, provided that when p is 0, $R^3$ is not hydrogen atom, or when q is 0, $R^4$ is not hydrogen atom; and (3) A working fluid composition for refrigerating machine comprising a lubricating oil composition including a phosphorus compound having two or more hydroxyl groups and a P—N bond in a molecule (simply abbreviated as "First Phosphorus Compound"), and a hydrofluorocarbon.

DETAILED DESCRIPTION OF THE INVENTION

1. First Phosphorus Compound

The phosphorus compound used in the present invention has two or more hydroxyl groups and a P—N bond in a molecule, and it is preferred that the phosphorus compound has two to four hydroxyl groups in a molecule, and further one P—N bond or two P—N bonds in which two nitrogen atoms are bonded to one phosphorus atom. In the present specification, this compound is referred to as "First Phosphorus Compound."

As to First Phosphorus Compound, there are included the following preferred compounds represented by the following general formula (1) or (2):

(1)

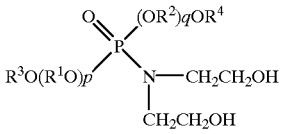

(2)

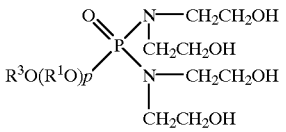

wherein $R^1$ and $R^2$, which may be identical or different, each represents a linear or branched alkylene group having 2 to 4 carbon atoms; p and q are from 0 to 30; and $R^3$ and $R^4$, which may be identical or different, each represents hydrogen atom; a linear alkyl group having 1 to 30 carbon atoms; a branched alkyl group having 3 to 30 carbon atoms; a linear alkenyl group having 2 to 30 carbon atoms; a branched alkenyl group having 3 to 30 carbon atoms; an aryl group having 6 to 30 carbon atoms; an aralkyl group having 7 to 30 carbon atoms; a halogenated alkyl group having 1 to 30 carbon atoms; or a halogenated aryl group having 6 to 30 carbon atoms, provided that when p is 0, $R^3$ is not hydrogen atom, or when q is 0, $R^4$ is not hydrogen atom.

(i) $R^3$ and $R^4$ in General Formulae (1) and (2)

Of the groups represented by $R^3$ and $R^4$, the number of carbon atoms in a linear or branched alkyl group, a linear or branched alkenyl group, an aryl group, an aralkyl group, a halogenated alkyl group, or a halogenated aryl group is 30 or less, preferably 24 or less, more preferably 18 or less, still more preferably 12 or less, from the viewpoint of preventing wear. From the aspects of improvement of thermal stability and oxidation stability, compounds without an unsaturated bond, a halogen atom, or a (poly)oxyalkylene group are more preferred. Also, in a case where this phosphorus compound is used in a working fluid composition for refrigerating machines, the number of carbon atoms is preferably 18 or less, more preferably 12 or less, from the viewpoint of compatibility with the hydrofluorocarbons.

Examples of the linear alkyl group having 1 to 30 carbon atoms include methyl group, ethyl group, propyl group, butyl group, pentyl group, hexyl group, heptyl group, octyl group, nonyl group, decyl group, dodecyl group, and the like.

Examples of the branched alkyl group having 3 to 30 carbon atoms include isopropyl group, 1-methylpropyl group, 2-methylpropyl group, t-butyl group, 2-methylbutyl group, 3-methylbutyl group, 2,2-dimethylpropyl group, cyclopentyl group, 2-methylpentyl group, 2-ethylbutyl group, 2,3-dimethylbutyl group, cyclohexyl group, 2-methylhexyl group, 3-methylhexyl group, 2-ethylpentyl group, 2-methylheptyl group, 2-ethylhexyl group, 3,5-dimethylhexyl group, 3,5,5-trimethylhexyl group, 2,4,6-trimethylheptyl group, and the like.

Examples of the linear alkenyl group having 2 to 30 carbon atoms include propenyl group, 2-decenyl group, 9-decenyl group, 9-undecenyl group, 10-undecenyl group, 2-dodecenyl group, 3-dodecenyl group, 2-tridecenyl group, 4-tetradecenyl group, 9-tetradecenyl group, 9-pentadecenyl group, 9-hexadecenyl group, 9-heptadecenyl group, 9-octadecenyl group, 11-dococenyl group, and the like.

Examples of the branched alkenyl group having 3 to 30 carbon atoms include isopropenyl group, 3-methyl-2-nonenyl group, 2,4-dimethyl-2-decenyl group, and the like.

Examples of the aryl group having 6 to 30 carbon atoms include phenyl group, 2,4,6-tri-t-butylphenyl group, and the like.

Examples of the aralkyl group having 7 to 30 carbon atoms include benzyl group, phenetyl group, 4-t-butylbenzyl group, and the like.

Examples of a halogen atom in the halogenated alkyl group having 1 to 30 carbon atoms and a halogen atom in the halogenated aryl group having 6 to 30 carbon atoms include fluorine atom, chlorine atom, bromine atom, iodine atom, and the like, with a preference given to chlorine atom.

(ii) $R^1$ and $R^2$ in General Formulae (1) and (2)

$R^1$ and $R^2$ each represents a linear or branched alkylene group having 2 to 4 carbon atoms. Examples of the linear or branched alkylene group having 2 to 4 carbon atoms include ethylene group, propylene group, trimethylene group, butylene group, isobutylene group, tetramethylene group, and the like.

Each of p and q is preferably a number of 0 to 30, more preferably 0 to 20, still more preferably 0 to 10, from the viewpoints of solubility to the base oil and giving good adding effects. Also, in a case where this phosphorus compound is used in a working fluid composition for refrigerating machines, each of p and q is a number of preferably 0 to 20, more preferably 0 to 10, still more preferably 0 to 5, from the viewpoint of electric insulating property. p and q may be identical or different.

The phosphorus compound represented by the general formula (1) or (2) can be obtained by a process comprising reacting phosphorus oxychloride with various alcohols, and reacting chloride of the resulting intermediate with diethanolamine. Specifically, the first step of the reaction can be carried out by using a base, including triethylamine, pyridine, or the like, as a capturing agent for hydrogen chloride in the absence or presence of a solvent, including tetrahydrofuran, hexane, or the like, or by removing generated hydrogen chloride from the reaction system. The removal process may be carried out while blowing an inert gas, including nitrogen gas or the like, into the reaction system. The reaction can be carried out by adding dropwise an alcohol compound to phosphorus oxychloride at a reaction temperature of from −400 to 30° C., preferably from −20° to 0° C.

The second step of the reaction can be carried out by adding dropwise the compound obtained in the first step of the reaction to diethanolamine in the absence or presence of a solvent, including tetrahydrofuran, hexane, or the like. In the second step, a base, including triethylamine, pyridine, or the like, may be used as a capturing agent for hydrogen chloride, or diethanolamine may be used as a capturing agent for hydrogen chloride. The reaction temperature is from 0° to 60° C., preferably from 20° to 40° C. Further, the reaction product may be purified by a procedure, including washing, adsorption, distillation, or the like, as occasion demands.

Incidentally, in the present invention, First Phosphorus Compound mentioned above may be used singly or in admixture of two or more kinds of the phosphorus compounds.

2. Second Phosphorus Compound

In the present invention, it is desired to use, together with First Phosphorus Compound, a compound represented by the general formula (3), (4) or (5) as second Phosphorus Compound:

(3)

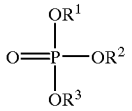

(4)

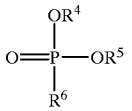

(5)

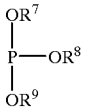

wherein $R^1$ to $R^5$ and $R^7$ to $R^9$, which may be identical or different, each represents an aryl group having 6 to 18 carbon atoms; a linear alkyl group having 1 to 18 carbon atoms; a branched alkyl group having 3 to 18 carbon atoms; a linear alkenyl group having 2 to 18 carbon atoms; or a branched alkenyl group having 3 to 18 carbon atoms; and $R^6$ represents hydrogen atom; a linear alkyl group having 1 to 18 carbon atoms; a branched alkyl group having 3 to 18 carbon atoms; a linear alkenyl group having 2 to 18 carbon atoms; or a branched alkenyl group having 3 to 18 carbon atoms.

(i) $R^1$ to $R^5$ and $R^7$ to $R^9$ in General Formulae (3) to (5)

The number of carbon atoms in each of $R^1$ to $R^5$ and $R^7$ to $R^9$ is 18 or less, preferably 12 or less, from the viewpoint of preventing wear. Also, in a case where this phosphorus compound is used in a working fluid composition for refrigerating machines, the number of carbon atoms is preferably 18 or less, more preferably 12 or less, still more preferably 8 or less, from the viewpoint of compatibility with the hydrofluorocarbons.

Examples of the aryl group having 6 to 18 carbon atoms include phenyl group, cresyl group, xylenyl group, 4-ethylphenyl group, 4-t-butylphenyl group, naphthyl group, 2-methylnaphthyl group, and the like.

Examples of the linear alkyl group having 1 to 18 carbon atoms include methyl group, ethyl group, propyl group, butyl group, pentyl group, hexyl group, heptyl group, octyl group, nonyl group, decyl group, dodecyl group, and the like.

Examples of the branched alkyl group having 3 to 18 carbon atoms include isopropyl group, 1-methylpropyl group, 2-methylpropyl group, t-butyl group, 2-methylbutyl group, 3-methylbutyl group, 2,2-dimethylpropyl group, cyclopentyl group, 2-methylpentyl group, 2-ethylbutyl group, 2,3-dimethylbutyl group, cyclohexyl group, 2-methylhexyl group, 3-methylhexyl group, 2-ethylpentyl group, 2-methylheptyl group, 2-ethylhexyl group, 3,5-dimethylhexyl group, 3,5,5-trimethylhexyl group, 2,4,6-trimethylheptyl group, 2,4,6,8-tetramethylnonyl group, and the like.

Examples of the linear alkenyl group having 2 to 18 carbon atoms include propenyl group, 2-decenyl group, 9-decenyl group, 9-undecenyl group, 10-undecenyl group, 2-dodecenyl group, 3-dodecenyl group, and the like.

Examples of the branched alkenyl group having 3 to 18 carbon atoms include isopropenyl group, 3-methyl-2-nonenyl group, and the like.

(ii) $R^6$ in General Formulae (3) to (5)

Of the groups represented by $R^6$, the number of carbon atoms in a linear or branched alkyl group or in a linear or branched alkenyl group is 18 or less, preferably 12 or less, from the viewpoint of preventing wear. Also, in a case where this phosphorus compound is used in a working fluid composition for refrigerating machines, the number of carbon atoms is preferably 18 or less, more preferably 12 or less, from the viewpoint of compatibility with the hydrofluorocarbons. Concrete examples of the alkyl group and the alkenyl group include the compounds listed in $R^1$ to $R^5$ and $R^7$ to $R^9$.

The method for producing Second Phosphorus Compound, which can be used in the present invention is a known method. Also, many phosphorus compounds are commercially available, and those compounds can be used in the present invention.

Accordingly, concrete examples of Second Phosphorus Compound suitably used in the present invention include triphenyl phosphite, tricresyl phosphite, tris(nonylphenyl) phosphate, tris(2,4-di-t-butylphenyl) phosphite, triphenyl phosphate, tricresyl phosphate, cresyl diphenyl phosphate, diphenylhydrogen phosphate, 2-ethylhexyl diphenyl phosphate, diphenyl 2-ethylhexyl phosphonate, and the like. Among them, a preference is given to tricresyl phosphate, triphenyl phosphite, tricresyl phosphate, and triphenyl phosphate. In the present invention, Second Phosphorus Compound mentioned above may be used singly or in admixture of two or more kinds of the phosphorus compounds.

The lubricating oil additive for polar oils of the present invention comprises the phosphorus compounds described above as effective ingredients. Particularly, excellent lubricity can be obtained by singly using First Phosphorus Compound represented by the general formula (1) or (2), or using First Phosphorus Compound together with Second Phosphorus Compound represented by the general formula (3), (4) or (5). Particularly, when using First Phosphorus Compound in combination with Second Phosphorus Compound, synergistic effects can be exhibited in wear resistance. Moreover, remarkable combined effects of adding both phosphorus compounds can be obtained even when using a small amount of First Phosphorus Compound as compared to the case of singly using First Phosphorus Compound. Accordingly, the combined addition is preferable from the viewpoints of economical advantages. Further, lubricating oil additives, including oxidation inhibitors, detergent dispersants, oiliness improvers, extreme pressure additives, viscosity index improvers, corrosion inhibitors, rust inhibitors, metal deactivators, or the like, can be used together with the phosphorus compounds.

The lubricating oil additive for polar oils of the present invention particularly has excellent lubricity because it has excellent adsorptivity to metal surfaces, as compared to the base oil in a case where the lubricating oil additive is used for the following polar oils.

3. Base Oil

Examples of the base oil which can be used in the present invention include mineral oils; hydrocarbon synthetic oils such as polybutenes, poly a-olefins and alkylbenzenes; aliphatic diesters, neopentyl polyol esters, polyalkylene glycols, polyphenyl ethers, carbonates, phosphoric esters, silicic acid esters, silicone oils, perfluoropolyethers, and the like, concrete examples of which are set forth in, for instance, "New Edition of Physicochemistry of Lubrication" (Saiwai Shobo, p.180–224, 1983), and "Basics and Application of Lubricating Oils" (Corona, p.6–35 and 307–340, 1992), each of whose entire contents are incorporated herein by reference.

Among them, in the oxygen-containing compounds having high polarity, such as aliphatic diesters, neopentyl polyol esters, polyalkylene glycols, polyphenyl ethers, carbonates, silicic acid esters, and perfluoropolyethers, the phosphorus compounds of the present invention exhibit notable improvement in lubricity, as compared to other phosphorus compounds. Specifically, it is desired in the lubricating oil composition of the present invention that a lubricating base oil comprises an oxygen-containing compound as a main component, and it is more desired that the oxygen-containing compound is one or more compounds selected from the group consisting of esters, cyclic ketals, cyclic acetals, polyethers, polyalkylene glycols, and carbonates.

Also, in a case where the lubricating oil composition including the phosphorus compound of the present invention is used in a working fluid composition for refrigerating machines, it is desired that the lubricating base oil comprises oxygen-containing compound, from the viewpoint of compatibility with the hydrofluorocarbons. It is more desired that the oxygen-containing compound is one or more compounds selected from the group consisting of esters, cyclic ketals, cyclic acetals, polyethers, polyalkylene glycols, and carbonates, and it is still more desired that the oxygen-containing compound is esters and cyclic ketals/cyclic acetals compounds.

(i) Ester Synthetic Oil

The ester synthetic oil which can be used in the present invention is not particularly limited as long as it is an ester compound which has compatibility with the hydrofluorocarbons, and has a pour point of 0C or less, and can dissolve the phosphorus compound represented by the general formula (1), (2), (3), (4) or (5). Preferred examples thereof include, for instance, ester compounds selected from the following groups:

(a) esters obtained from a saturated, divalent to hexavalent, aliphatic polyhydric alcohol having 2 to 10 carbon atoms and a linear or branched, saturated, aliphatic monocarboxylic acid having 2 to 9 carbon atoms or a derivative thereof;

(b) esters obtained from a linear or branched, saturated, aliphatic monohydric alcohol having 1 to 10 carbon atoms and a divalent to hexavalent, polycarboxylic acid having 2 to 10 carbon atoms or a derivative thereof;

(c) esters obtained from a saturated, divalent to hexavalent, aliphatic polyhydric alcohol having 2 to 10 carbon atoms and a mixed acid of a linear or branched, saturated, aliphatic monocarboxylic acid having 2 to 9 carbon atoms or a derivative thereof, and a linear or branched, saturated, aliphatic dicarboxylic acid having 2 to 10 carbon atoms or a derivative thereof; and (d) esters obtained from a mixed alcohol of a saturated, divalent to hexavalent, aliphatic polyhydric alcohol having 2 to 10 carbon atoms and a linear or branched, saturated, aliphatic monohydric alcohol having 1 to 10 carbon atoms, and a divalent to hexavalent, polycarboxylic acid having 2 to 10 carbon atoms or a derivative thereof.

In the esters described in (a) to (d), which can be used in the present invention, the ester compounds described in (a) are particularly preferable in consideration of being well balanced in the required properties, such as the compatibility with the hydrofluorocarbons, thermal stability, lubricity, electric insulating property, and the like. Among the esters described in (a), the hindered esters obtained from a divalent to hexavalent, hindered alcohol having 2 to 10 carbon atoms desirably used as a polyhydric alcohol, and a saturated, aliphatic monocarboxylic acid having 5 to 9 carbon atoms as a monocarboxylic acid are still more preferable.

Concrete examples of the preferred esters described in (a) include neopentyl glycol 3,5,5-trimethylhexanoate; neopentyl glycol 2-ethylhexanoate; trimethylolpropane 3,5,5-trimethylhexanoate; an ester obtained from trimethylolpropane and a mixed acid of 2-methylhexanoic acid, 2-ethylpentanoic acid, and 3,5,5-trimethylhexanoic acid; trimethylolpropane 2-ethylhexanoate; an ester obtained from trimethylolpropane and a mixed acid of 2-methylhexanoic acid and 2-ethylpentanoic acid; an ester obtained from pentaerythritol and a mixed acid of valeric acid, isovaleric acid, and 3,5,5-trimethylhexanoic acid; an ester obtained from pentaerythritol and a mixed acid of enanthic acid and 3,5,5-trimethylhexanoic acid; an ester obtained from pentaerythritol and a mixed acid of 2-ethylhexanoic acid and 3,5,5-trimethylhexanoic acid; an ester obtained from pentaerythritol and a mixed acid of 2-methylhexanoic acid, 2-ethylpentanoic acid, and 2-ethylhexanoic acid; an ester obtained from pentaerythritol and a mixed acid of caprylic acid and 3,5,5-trimethylhexanoic acid; an ester obtained from pentaerythritol and a mixed acid of 2-methylhexanoic acid, 2-ethylpentanoic acid, 2-ethylhexanoic acid, and 3,5,5-trimethylhexanoic acid, and the like.

The esters used in the present invention can be prepared by a conventionally known method including esterification reaction, transesterification reaction, or the like, from the compounds mentioned above.

The acid value of the ester prepared by the methods described above which can be used in the present invention is not particularly limited. It is desired that the acid value is 1 mg KOH/g or less, preferably 0.2 mg KOH/g or less, more preferably 0.1 mg KOH/g or less, still more preferably 0.05 mg KOH/g or less, from the viewpoints of corrosion resistance to metal materials, wear resistance, thermal stability, and electric insulating property.

The hydroxyl value of the ester which can be used in the present invention is not particularly limited. It is desired that the hydroxyl value is from 0.1 to 50 mg KOH/g, preferably from 0.1 to 30 mg KOH/g, more preferably from 0.1 to 20 mg KOH/g. The hydroxyl value is preferably from 0.1 mg KOH/g or more, from the viewpoint of wear resistance, and the hydroxyl value is preferably 50 mg KOH/g or less, from the viewpoint of hygroscopicity.

The iodine value (I g/100 g) of the ester which can be used in the present invention is not particularly limited. It is desired that the iodine value is 10 or less, preferably 5 or less, more preferably 3 or less, still more preferably 1 or less, from the viewpoint of thermal oxidation stability of the resulting lubricating oil composition.

The two-phase separation temperature between the ester which can be used in the present invention and hydrofluorocarbon at a low temperature is not particularly limited. It is desired that the two-phase separation temperature is −10° C. or less, preferably −30° C. or less, more preferably −50° C. or less.

The kinematic viscosity at 100° C. of the ester which can be used in the present invention is not particularly limited. It is desired that the kinematic viscosity is 100 $mm^2/s$ or less, preferably 1 to 100 $mm^2/s$, more preferably 1 to 30 $mm^2/s$, from the viewpoint of compatibility of the ester with the hydrofluorocarbons.

(ii) Cyclic Ketal/Cyclic Acetal Synthetic Oil

The cyclic ketal/cyclic acetal synthetic oil which can be used in the present invention is not particularly limited as long as it is a cyclic ketal/cyclic acetal compound which has compatibility with the hydrofluorocarbons, and has a pour point of 0° C. or less, and can dissolve the phosphorus compound represented by the general formula (1), (2), (3), (4) or (5). Preferred examples of the cyclic ketal/cyclic acetal compound include cyclic ketals or cyclic acetals obtained by a reaction between one or more polyhydric alcohols having an even number of hydroxyl groups of 4 or more and 8 or less and one or more carbonyl compounds represented by the general formula (10):

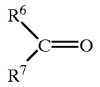

(10)

wherein $R^6$ represents hydrogen atom, a linear alkyl group having 1 to 12 carbon atoms, a branched alkyl group having 3 to 12 carbon atoms, or a cyclic alkyl group having 3 to 12 carbon atoms; and $R^7$ represents a linear alkyl group having 1 to 12 carbon atoms, a branched alkyl group having 3 to 12 carbon atoms, or a cyclic alkyl group having 3 to 12 carbon atoms; or alternatively, $R^6$ and $R^7$ may together form an alkylene group having 2 to 13 carbon atoms, and wherein a total number of carbon atoms of $R^6$ and $R^7$ is from 1 to 13, or one or more ketals or acetals which are reactive derivatives of the carbonyl compounds.

It is desired that the polyhydric alcohol, the starting material of the cyclic ketals or the cyclic acetals which can be used in the present invention, has 4, 6, or 8 hydroxyl groups.

Also, it is desired that the polyhydric alcohol, the starting material of the cyclic ketals or the cyclic acetals which can be used in the present invention, has 4 to 25 carbon atoms, preferably 4 to 15 carbon atoms.

The carbonyl compound, the starting material of the cyclic ketals or the cyclic acetals which can be used in the present invention, is a ketone or aldehyde represented by the general formula (10):

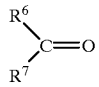

(10)

The number of carbon atoms of the ketone or aldehyde represented by the general formula (10) is from 2 to 14, preferably from 2 to 11, more preferably from 2 to 6. It is desired that the number of carbon atoms is 14 or less, from the viewpoint of compatibility of the cyclic ketals or cyclic acetals with the hydrofluorocarbons.

$R^6$ represents hydrogen atom, a linear alkyl group having 1 to 12 carbon atoms, a branched alkyl group having 3 to 12 carbon atoms, or a cyclic alkyl group having 3 to 12 carbon atoms. $R^7$ represents a linear alkyl group having 1 to 12 carbon atoms, a branched alkyl group having 3 to 12 carbon atoms, or a cyclic alkyl group having 3 to 12 carbon atoms, preferably a linear alkyl group having 1 to 8 carbon atoms, a branched alkyl group having 3 to 8 carbon atoms, or a cyclic alkyl group having 3 to 8 carbon atoms. Alternatively, $R^6$ and $R^7$ may together form an alkylene group having 2 to 13 carbon atoms. In all cases mentioned above, the total number of carbon atoms of $R^6$ and $R^7$ is 1 to 13.

Concrete examples of ketones in which both $R^6$ and $R^7$ are alkyl groups include acetone, methyl ethyl ketone, methyl propyl ketone, and the like. Concrete examples of ketones in which $R^6$ and $R^7$ together form an alkylene group include cyclopentanone, cyclohexanone, and the like. Concrete examples of aldehydes in which $R^6$ is hydrogen atom include acetaldehyde, propionaldehyde, butyraldehyde, isobutyraldehyde, and the like.

Also, the reactive derivatives of the carbonyl compounds used in the present invention are ketals and acetals which can readily be obtained by the reaction of the ketone or aldehyde as mentioned above with a lower alcohol having 1 to 6 carbon atoms in the presence of an acid catalyst.

The cyclic ketals or cyclic acetals used for the lubricating oil composition in the present invention can be obtained as described below. A polyhydric alcohol, and at least one of the ketone, the aldehyde, and the ketal or acetal which is a reactive derivative of the ketone or aldehyde are reacted in the presence of an acid catalyst, including, for instance, p-toluenesulfonic acid, methanesulfonic acid, or sulfuric acid, wherein the acid catalyst is added in an amount of 0.05 to 10 mol % to the amount of the polyhydric alcohol.

Also, when a hexahydric alcohol, including sorbitol, mannitol, galactitol, iditol, talitol, allitol, or the like, is used, the cyclic ketals or cyclic acetals represented by the general formula (11a) and (11b) can be obtained. Among the cyclic ketals or cyclic acetals obtained, those represented by the general formula (11a) having three 1,3-dioxolan structures are preferred from the viewpoint of giving high electric insulating property in the resulting composition. Alternatively, when erythritol is used, the cyclic ketals or cyclic acetals represented by the general formula (12a) and (12b) are obtained. Among the cyclic ketals or cyclic acetals obtained, those represented by the general formula (12a) having two 1,3-dioxolan structures are preferred from the viewpoint of giving high electric insulating property in the resulting composition.

(11)

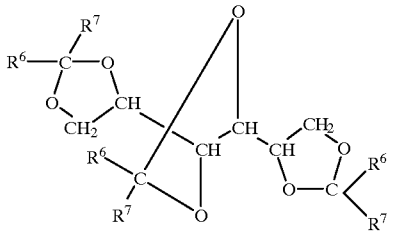

(11a)

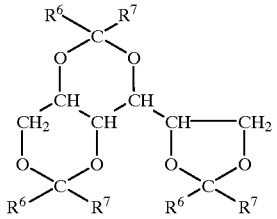

(11b)

(12)

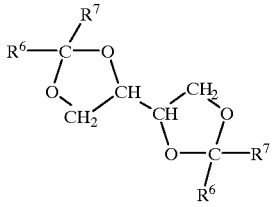

(12a)

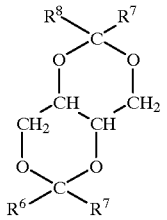

(12b)

It is desired that the melting point of the cyclic ketal or cyclic acetal which can be used in the present invention is 10° C. or less.

It is desired that the cyclic ketal or cyclic acetal which can be used in the present invention has a viscosity at 100° C. of 1 $mm^2/s$ or more and 100 $mm^2/s$ or less.

It is desired that the two-phase separation temperature between the cyclic ketal or cyclic acetal used in the present invention and the hydrofluorocarbon is low, and the two-phase separation temperature is desirably 10° C. or less.

(iii) Polyether Synthetic Oil

The polyether synthetic oil which can be used in the present invention is not particularly limited as long as it is a polyether compound which has compatibility with the hydrofluorocarbons, and has a pour point of 0° C. or less, and can dissolve the phosphorus compound represented by the general formula (1), (2), (3), (4) or (5). Preferred examples of the polyether compound include polyvinyl ether compounds disclosed in Japanese Patent Laid-Open No. 6-128578, of whose entire contents are incorporated herein by reference, and polyether compounds represented by the general formula (16):

(16)

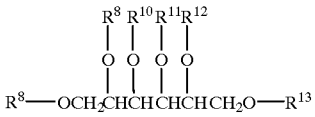

wherein each of $R^8$ to $R^{13}$, which may be identical or different, represents a linear alkyl group having 1 to 14 carbon atoms, a branched alkyl group having 3 to 14 carbon atoms, or a cyclic alkyl group having 3 to 14 carbon atoms, wherein the total number of carbon atoms of $R^8$ to $R^{13}$ is 8 to 40.

In the compounds represented by the general formula (16), concrete examples of the hexahydric alcohols, which give the hexahydric alcohol residues, excluding the residues $R^8O$— to $R^{13}O$—, include, for instance, hexytols, such as sorbitol, mannitol, galactitol, iditol, talitol, and allitol, each of which can be obtained by reducing hexoses.

From the viewpoints of availability and costs, sorbitol is the most preferable.

The ether compounds represented by the general formula (16) can be produced by various methods. For example, the ether compound can be produced by reacting a hexitol alcoholate, a reactive derivative of a hexitol, with an alkyl halide.

Alternatively, the ether compound represented by the general formula (16) can be prepared by hydrogenating the cyclic ketal or the cyclic acetal represented by the general formula (11), to give a polyol ether alcohol, and further alkyl-capping the resulting polyol ether alcohol, to give an ether compound. Incidentally, as for hydrogenating catalyst, palladium, especially with a pH of 5 to 8, is particularly preferable.

The polyether compound represented by the general formula (16) is obtained by treating the hydroxyl group moiety of the polyhydric ether alcohols obtained by the above-mentioned process with a base, including, Na, NaH, or the like, to give a corresponding alcoholate; and ether-capping (or alkyl-capping) the resulting alcoholate with an alkylating agent, including an alkyl halide, a dialkyl sulfate, or the like.

The kinematic viscosity at 100° C. of the polyether compound used in the present invention is preferably from 0.5 to 30 $mm^2/s$, more preferably from 1 to 15 $mm^2/s$. It is desired that the kinematic viscosity at 100° C. of the polyether compounds is 30 $mm^2/s$ or less from the viewpoint of compatibility with the hydrofluorocarbons. The kinematic viscosity at 40° C. of the polyether compound used in the present invention is preferably from 1 to 300 $mm^2/s$, more preferably from 5 to 100 $mm^2/s$. The two-phase separation temperature at a low temperature between the polyether compound used in the present invention and the hydrofluorocarbons is not particularly limited. It is desired that the two-phase separation temperature at a low temperature is 10° C. or less, preferably 0° C. or less, more preferably −10° C. or less.

(iv) Polyalkylene Glycol Synthetic Oil

The polyalkylene glycol synthetic oil which can be used in the present invention is not particularly limited as long as it is a polyalkylene glycol compound which has compatibility with the hydrofluorocarbons, and has a pour point of 0° C. or less, and can dissolve the phosphorus compound represented by the general formula (1), (2), (3), (4) or (5). Examples thereof include, for instance, the compounds represented by the following general formula (18):

$$A—(O—(R^{14}O)v—R^{15})w \quad (18)$$

wherein $R^{14}$ represents a linear or branched alkylene group having 2 to 4 carbon atoms; $R^{15}$ represents hydrogen atom, a hydrocarbon group having 1 to 15 carbon atoms, or an acyl group having 2 to 15 carbon atoms; A represents hydrogen atom, a residue of a w-valent alcohol having 1 to 15 carbon atoms, or a residue of a w-valent phenol having 6 to 15 carbon atoms; v is a number of from 1 to 50; and w is a number of from 1 to 6, with proviso that each of v units of $R^{14}O$, w units of $R^{15}$, and w units of $O—(R^{14}O)v—R^{15}$, respectively, may be identical or different.

Concrete examples of $R^{14}$ include, for instance, the groups listed in $R^1$ and $R^2$ of the general formula (1) and (2).

The number of carbon atoms in $R^{15}$ is preferably 15 or less, from the viewpoint of compatibility with the hydrofluorocarbons.

The number of carbon atoms in A is preferably 15 or less, from the viewpoint of compatibility with the hydrofluorocarbons.

v is a number of preferably 50 or less, more preferably a number of from 1 to 30, from the viewpoints of viscosity and hygroscopicity. w is a number of preferably 6 or less, more preferably from 1 to 3, from the viewpoint of viscosity.

The polyalkylene glycol can be prepared by a process as described below. Specifically, an alkylene oxide is reacted with water or an alcohol in the presence of an alkali catalyst, including NaOH, KOH, or the like, to give a monoalkyl ether-type polyalkylene glycol or a glycol-type polyalkylene glycol, and the terminal hydroxyl groups of the resulting polyalkylene glycol is alkyl-capped with an alkyl halide in the presence of an alkali metal as a catalyst. In the alternative, acylation of the monoalkyl ether-type polyalkylene glycol or the glycol-type polyalkylene glycol is carried out by reacting the monoalkyl ether-type polyalkylene glycol or the glycol-type polyalkylene glycol with a carboxylic acid, or a methyl ester thereof, an ethyl ester thereof or an acid anhydride thereof, to give a dialkyl ether-type polyalkylene glycol or an ester-ether-type polyalkylene glycol.

It is desired that the acid value of the polyalkylene glycol prepared by the above-mentioned process, which can be used in the present invention, is 1 mg KOH/g or less, preferably 0.2 mg KOH/g or less, more preferably 0.1 mg KOH/g or less, still more preferably 0.05 mg KOH/g or less, from the viewpoints of corrosion resistance to metal materials, wear resistance, thermal stability, and electric insulating property.

It is desired that the two-phase separation temperature at a low temperature between the polyalkylene glycol which can be used in the present invention and the hydrofluorocarbons is −10° C. or less, preferably −30° C. or less, more preferably −50° C. or less. Also, it is desired that the two-phase separation temperature at a high temperature is 60° C. or more, preferably 80° C. or more, more preferably 100° C. or more.

It is desired that the kinematic viscosity at 100° C. of the polyalkylene glycol used in the present invention is 100 $mm^2/s$ or less, preferably 1 to 100 $mm^2/s$, more preferably 1 to 30 $mm^2/s$, from the viewpoint of compatibility with the hydrofluorocarbons.

(v) Carbonate Synthetic Oil

The carbonate synthetic oil which can be used in the present invention is not particularly limited as long as it is a carbonate compound which has compatibility with the hydrofluorocarbons, and has a pour point of 0° C. or less, and can dissolve the phosphorus compound represented by the general formula (1), (2), (3), (4) or (5). Examples of the carbonate compound include, for instance, compounds represented by the following general formula (19):

$$R^{16}—O\underset{\underset{O}{\|}}{C}O—\{(R^{17}O)x—\underset{\underset{O}{\|}}{C}O\}y—R^{18} \quad (19)$$

wherein each of $R^{16}$ and $R^{18}$, which may be identical or different, represents an alkyl group having 1 to 18 carbon atoms; an aryl group having 6 to 18 carbon atoms; an aralkyl group having 7 to 18 carbon atoms; or a group represented by $—(R^{20}O)z—R^{19}$, wherein $R^{19}$ represents an alkyl group having 1 to 18 carbon atoms, an aryl group having 6 to 18 carbon atoms, or an aralkyl group having 7 to 18 carbon atoms, and wherein $R^{20}$ represents an alkylene group having 2 to 18 carbon atoms, an arylene group having 6 to 18 carbon atoms, or an aralkylene group having 7 to 18 carbon atoms; z is an integer of from 1 to 100, wherein each of z units of $R^{20}O$ may be identical or different; $R^{17}$ represents an alkylene group having 2 to 18 carbon atoms, an arylene group having 6 to 18 carbon atoms, or an aralkylene group having 7 to 18 carbon atoms; x is an integer of from 1 to 100; and y is an integer of from 0 to 100, wherein each of x units of $R^{17}O$ may be identical or different, and wherein each of y units of $$(R^{17}O)x—\underset{\underset{O}{\|}}{C}O$$

may be identical or different.

$R^{16}$ and $R^{18}$ represent an alkyl group having 1 to 18 carbon atoms; an aryl group having 6 to 18 carbon atoms; an aralkyl group having 7 to 18 carbon atoms; or a group represented by $—(R^{20}O)z—R^{19}$, wherein $R^{19}$ represents an alkyl group having 1 to 18 carbon atoms, an aryl group having 6 to 18 carbon atoms, or an aralkyl group having 7 to 18 carbon atoms. Here, each of the number of carbon atoms in $R^{16}$, $R^{18}$, and $R^{19}$ is preferably 18 or less, from the viewpoint of compatibility with the hydrofluorocarbons.

$R^{17}$ and $R^{20}$ represent an alkylene group having 2 to 18 carbon atoms; an arylene group having 6 to 18 carbon atoms; or an aralkylene group having 7 to 18 carbon atoms. Each of the number of carbon atoms in $R^{17}$ and $R^{20}$ is preferably 18 or less, from the viewpoint of compatibility with the hydrofluorocarbons.

z is an integer of from 1 to 100. x is an integer of from 1 to 100. y is an integer of from 0 to 100.

The carbonates can be generally obtained by the transesterification reaction between one or more alcohol compounds selected from monohydric and dihydric alcohols and phenol, and a carbonate, including dimethyl carbonate, diethyl carbonate, or the like.

It is desired that the acid value of the carbonate obtained by the above-mentioned process which can be used in the present invention is 1 mg KOH/g or less, preferably 0.2 mg KOH/g or less, more preferably 0.1 mg KOH/g or less, still more preferably 0.05 mg KOH/g or less, from the viewpoints of corrosion resistance to metal materials, wear resistance, thermal stability, and electric insulating property.

It is desired that the two-phase separation temperature at a low temperature between the carbonate which can be used in the present invention and hydrofluorocarbons is 0° C. or less, preferably −10° C. or less, more preferably −30° C. or less.

The kinematic viscosity at 100° C. of the carbonate which can be used in the present invention is not particularly limited. It is desired that the esters have a kinematic viscosity of 100 $mm^2/s$ or less, from the viewpoint of compatibility with the hydrofluorocarbons.

(vi) Mixed Oil

In the present invention, a mixed oil of synthetic oils of esters, cyclic ketals, cyclic acetals, polyethers, polyalkylene glycols, and carbonates may be used.

4. Lubricating Oil Composition and Working Fluid Composition For Refrigerating Machines (1) Lubricating Oil Composition in Present Invention The lubricating oil composition in the present invention can be prepared by adding the phosphorus compounds mentioned above to the lubricating base oil, preferably a base oil comprising the oxygen-containing compound as a main component. Specifically, the oxygen-containing compound include synthetic oils of esters, cyclic ketals, cyclic acetals, polyethers, polyalkylene glycols, carbonates, and mixed oils thereof.

The amount of First Phosphorus Compound to the a lubricating base oil is not particularly limited, as long as the amount is at least sufficient to prevent wear during contact of the lubricating oil composition of the present invention to metal surfaces. It is desired that the amount of First Phosphorus Compound is 0.03 to 5.0 parts by weight, preferably 0.05 to 3.0 parts by weight, more preferably 0.1 to 2.0 parts by weight, based on 100 parts by weight of the lubricating base oil. It is desired that the amount of First Phosphorus Compound is 0.03 parts by weight or more, from the viewpoint of preventing wear, and that the amount of First Phosphorus Compound is 5.0 parts by weight or less, from the viewpoints of thermal stability of the base oil and economic advantages.

Also, when using First Phosphorus Compound represented by the general formula (1) or (2) in combination with Second Phosphorus Compound represented by the general formula (3), (4), or (5), effects of preventing wear can be synergistically exhibited. Specifically, when using the phosphorus compounds in combination, it is desired that the amount of First Phosphorus Compound represented by the general formula (1) or (2) to be added is 0.001 to 5.0 parts by weight, based on 100 parts by weight of the lubricating base oil, and that the amount of Second Phosphorus Compound represented by the general formula (3), (4), or (5) to be added is 0.03 to 5.0 parts by weight, based on 100 parts by weight of the lubricating base oil. Moreover, by the combined addition of the phosphorus compounds, effects of preventing wear can be exhibited even with a smaller amount of First Phosphorus Compound represented by the general formula (1) or (2). Accordingly, it is more desired that the amount of First Phosphorus Compound represented by the general formula (1) or (2) is 0.001 to 1.0 part by weight, based on 100 parts by weight of the lubricating base oil, and that the amount of Second Phosphorus Compound represented by the general formula (3), (4), or (5) is 0.03 to 5.0 parts by weight, based on 100 parts by weight. It is still more desired that the amount of First Phosphorus Compound represented by the general formula (1) or (2) is 0.001 to 0.5 parts by weight, based on 100 parts by weight of the lubricating base oil, and that the amount of Second Phosphorus Compound represented by the general formula (3), (4), or (5) is 0.03 to 3.0 parts by weight, based on 100 parts by weight of the lubricating base oil. It is still more desired that the amount of First Phosphorus Compound represented by the general formula (1) or (2) is 0.001 to 0.1 part by weight, based on 100 parts by weight of the lubricating base oil, and that the amount of Second Phosphorus Compound represented by the general formula (3), (4), or (5) is 0.03 to 1.0 part by weight, based on 100 parts by weight.

When the lubricating oil composition in the present invention is used for a working fluid composition for refrigerating machines, the following additives may be suitably added.

(i) An additive for removing water may be added to the lubricating oil composition in the present invention. In the co-presence of water, the base oil, including an ester or carbonate, can be hydrolyzed to form a carboxylic acid, which may result in plugged capillary tubes in refrigerating machines, or to produce non-condensed $CO_2$, thereby making the refrigeration ability poor. Also, the electric insulating materials, such as PET film, are likely to be hydrolyzed in the co-presence of water to form PET oligomers, which may result in plugged capillary tubes in the refrigerating machines.

Examples of the additives for removing water include compounds having an epoxy group, orthoesters, acetals (ketals), carbodiimides, and the like.

(ii) Further, in the lubricating oil composition in the present invention, benzotriazole and/or benzotriazole derivatives may be added to protect metal surfaces for the purpose of preventing metal corrosion by a carboxylic acid; phenol compounds having radical trapping ability may be added for improving thermal stability; and metal deactivators having chelating ability may be also added.

(iii) When the lubricating oil composition of the present invention is used for applications other than the working fluid composition for refrigerating machines, various conventional additives can be used as occasion demands. Examples of the lubricating oil additives include oxidation inhibitors, extreme pressure additives, oiliness improvers, anti-foaming agents, detergent dispersants, viscosity index improvers, rust inhibitors, demulsifiers, and the like.

(2) Working Fluid Composition For Refrigerating Machines of Present Invention

In the working fluid composition for refrigerating machines of the present invention, the mixing ratio of the hydrofluorocarbon to the lubricating oil composition is not particularly limited. It is desired that the mixing ratio of the hydrofluorocarbon to the lubricating oil composition is 50/1 to 1/20 by weight, preferably 10/1 to 1/5 by weight. It is desired that the proportion of the hydrofluorocarbon is 1/20 by weight or more in the hydrofluorocarbon/lubricating oil composition ratio, from the viewpoint of obtaining sufficient refrigeration ability, and that the proportion of the lubricating oil composition is 50/1 by weight or more, from the viewpoint of suitably controlling viscosity of the working fluid composition for refrigerating machines.

The hydrofluorocarbons which can be used in the present invention are not particularly limited, as long as they are compounds conventionally used for refrigeration oils. Preferred examples thereof include difluoromethane (HFC32), 1,1-difluoroethane (HFC152a), 1,1,1-trifluoroethane (HFC143a), 1,1,1,2-tetrafluoroethane (HFC134a), 1,1,2,2-tetrafluoroethane (HFC134), pentafluoroethane (HFC125), and the like, with a particular preference given to 1,1,1,2-tetrafluoroethane, difluoromethane, pentafluoroethane, and 1,1,1-trifluoroethane. Those hydrofluorocarbons may be used singly or in admixture of two or more kinds.

EXAMPLES

The present invention will be described in further detail by means of the following working examples.

Phosphorus Compounds a to k and Base Oils A to J used in Examples are listed below.

Phosphorus

Compound a: O,O-Di-n-butyl-N,N-bis-(2-hydroxyethyl) phosphoroamidate (formula 21a);

Phosphorus

Compound b: O,O-Di-2-ethylhexyl-N,N-bis-(2-hydroxyethyl)phosphoroamidate (formula 21b);

Phosphorus

Compound c: O,O-Di-n-dodecyl-N,N-bis-(2-hydroxyethyl)phosphoroamidate (formula 21c);

Phosphorus

Compound d: O,O-Diisopropyl-N,N-bis-(2-hydroxyethyl)phosphoroamidate (formula 21d);

Phosphorus

Compound e: O-n-Dodecyl-N,N,N,N-tetrakis-(2-hydroxyethyl)phosphorodiamidate (formula 22);

Phosphorus

Compound f: Di-2-ethylhexyl-2-hydroxypropyl phosphate (formula 23);

Phosphorus

Compound g: Tricresyl phosphate;

Phosphorus

Compound h: Tri-2-ethylhexyl phosphate;

Phosphorus

Compound i: Di-2-ethylhexyl phosphate;

Phosphorus

Compound j: O,O-Di-2-ethylhexyl-N-methyl-N-(2-hydroxyethyl)phosphoroamidate (formula 24); and Phosphorus Compound k: Triphenyl phosphate;

(21)

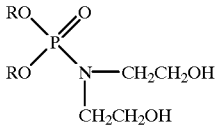

a: R=n-butyl
b: R=2-ethylhexyl
c: R=n-dodecyl
d: R=isopropyl (22)

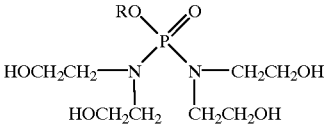

R=n-dodecyl (23)

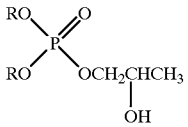

R=2-ethylhexyl

-continued (24)

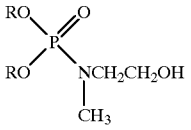

R=2-ethylhexyl

Base

Oil A: Ester obtained from pentaerythritol (1.0 mol) and a mixed acid of 2-ethylhexanoic acid (1.93 mol) and 3,5,5-trimethylhexanoic acid (2.07 mol);

viscosity at 40° C. (hereinafter simply referred to as "Vis 40"): 70.2 $mm^2/s$;

viscosity at 100° C. (hereinafter simply referred to as "Vis 100"): 8.63 $mm^2/s$;

acid value: 0.01 mg KOH/g; and hydroxyl value: 2.4 mg KOH/g;

Base

Oil B: Ester obtained from pentaerythritol (1.0 mol) and a mixed acid of 2-methylhexanoic acid (1.88 mol), 2-ethylpentanoic acid (0.46 mol), and 2-ethylhexanoic acid (1.66 mol);

Vis 40: 30.9 $mm^2/s$;

Vis 100: 5.21 $mm^2/s$;

acid value: 0.01 mg KOH/g; and hydroxyl value: 1.1 mg KOH/g;

Base

Oil C: Ester obtained from trimethylolpropane (1.0 mol) and 3,5,5-trimethylhexanoic acid (3.0 mol);

Vis 40: 51.9 $mm^2/s$;

Vis 100: 7.13 $mm^2/s$;

acid value: 0.01 mg KOH/g; and hydroxyl value: 0.89 mg KOH/g;

Base

Oil D: Ester obtained from pentaerythritol (1.0 mol) and a mixed acid of n-heptanoic acid (1.37 mol) and 3,5,5-trimethylhexanoic acid (2.63 mol);

Vis 40: 56.4 $mm^2/s$;

Vis 100: 8.08 $mm^2/s$;

acid value: 0.01 mg KOH/g; and hydroxyl value: 1.8 mg KOH/g;

Base

Oil E: 1.2:3.4:5.6-Tri-O-(1-methylpropylidene) sorbitol (formula 11a ($R^6$=methyl, $R^7$=ethyl));

Vis 40: 63.1 $mm^2/s$;

Vis 100: 4.54 $mm^2/s$;

acid value: 0.01 mg KOH/g; and hydroxyl value: 0.0 mg KOH/g;

Base

Oil F: 2,3,4,5-Tetra-O-methyl-1,6-di-O-(3,5,5-trimethylhexyl) sorbitol (formula 16 ($R^8$,$R^{13}$=3,5,5-trimethylhexyl, $R^9$, $R^{10}$, $R^{11}$, $R^{12}$=methyl));

Vis 40: 27.0 $mm^2/s$;

Vis 100: 4.62 $mm^2/s$;

acid value: 0.01 mg KOH/g; and hydroxyl value: 0.1 mg KOH/g;

Base

Oil G: Poly(oxyethylene-oxypropylene) glycol monobutyl ether ("NEWPOL 50HB-100," Sanyo Chemical Industries, Ltd.);

Vis 40: 20.3 $mm^2/s$;

Vis 100: 4.83 $mm^2/s$;

acid value: 0.03 mg KOH/g; and hydroxyl value: 104 mg KOH/g;

Base

Oil H: Polyoxypropylene glycol dihexanate;

Vis 40: 17.2 $mm^2/s$;

Vis 100: 3.86 $mm^2/s$;

acid value: 0.02 mg KOH/g; and hydroxyl value: 1.2 mg KOH/g;

Base

Oil I: Carbonate obtained from dimethyl carbonate (1.0 mol) and a mixed alcohol of 3-methyl-1,5-pentanediol (0.6 mol) and 3-methylhexanol (0.8 mol);

Vis 40: 31.6 $mm^2/s$;

Vis 100: 5.93 $mm^2/s$;

acid value: 0.02 mg KOH/g; and hydroxyl value: 0.54 mg KOH/g; and

Base

Oil J: Mineral oil ("SUNISO4GS," manufactured by Japan Sun Oil Company, Ltd.)

Vis 40: 55.5 $mm^2/s$;

Vis 100: 5.87 $mm^2/s$;

In Examples, the viscosities (Vis 40, Vis 100) of the above base oils were measured by a method according to JIS K-2283. Also, the acid values and the hydroxyl values were measured by a method according to JIS K-2501.

Example 1

In order to evaluate the lubricity of each of the lubricating oil compositions of the present invention, the friction coefficient was measured by carrying out Soda pendulum-type friction machine test at 25° C.

The results are shown in Tables 1 and 2.

TABLE 1

| | Lubricating Oil Composition | | |
|---|---|---|---|
| | Base Oil | Phosphorus Compound (Amount)* | Friction Coefficient |
| Inventive Product 1 | J | b (0.5) | 0.143 |
| Inventive Product 2 | J | c (0.5) | 0.127 |
| Comparative Product 1 | J | Not Added | 0.263 |
| Comparative Product 2 | J | g (0.5) | 0.213 |

Remark*: Amount based on 100 parts by weight of the base oil.

TABLE 2

| | Lubricating Oil Composition | | |
|---|---|---|---|
| | Base Oil | Phosphorus Compound (Amount)* | Friction Coefficient |
| Inventive Product 3 | A | b (0.5) | 0.126 |
| Inventive Product 4 | A | c (0.5) | 0.115 |

TABLE 2-continued

| | Lubricating Oil Composition | | |
|---|---|---|---|
| | Base Oil | Phosphorus Compound (Amount)* | Friction Coefficient |
| Comparative Product 3 | A | Not Added | 0.142 |
| Comparative Product 4 | A | g (0.5) | 0.143 |
| Comparative Product 5 | A | h (0.5) | 0.140 |

Remark*: Amount based on 100 parts by weight of the base oil.

As shown in Tables 1 and 2, Inventive Products have notably lower friction coefficients, as compared to those of Comparative Products, thereby showing excellent lubricity. In particular, as shown in Table 2, in lubricating oil compositions containing an oxygen-containing compound having a high polarity such as an ester, in contrast to Comparative Products where substantially no decrease in the friction coefficient takes place relative to the friction coefficient of the lubricating oil composition in which the phosphorous compound is "not added," Inventive Product shows a marked decrease in the friction coefficient relative to the friction coefficient of the lubricating oil composition in which the phosphorous compound is "not added." Therefore, it can be found that effects of the present invention are marked exhibited.

Example 2

In order to evaluate the wear resistance of Inventive Products, Falex test was carried out by a method according to ASTM D 2670-81.

A given amount of one phosphorous compound shown in Table 3 was added to each of 100 parts by weight of Base Oils A to I, to prepare a lubricating oil composition. A V-block and a pin were immersed to the resulting lubricating oil composition. While blowing 1,1,1,2-tetrafluoroethane at a rate of 10 liters/hr, the pin was rotated for ten minutes without a load at a temperature of 80° C. Subsequently, the pin was preliminarily rotated for five minutes while applying a load of 200 lbs., and then the test device was operated for three hours while applying a load of 300 lbs. The wear amount of the V-block and the pin after operation was measured.

Incidentally, the following lubricating oil compositions were used as Comparative Products:

lubricating oil compositions comprising each of Base Oils A to I without containing the phosphorous compound of the present invention;

lubricating oil compositions comprising each of Base Oils A, B, and E together with Phosphorous Compounds f to h, namely, together with di-2-ethylhexyl-2-hydroxypropyl phosphate, tricresyl phosphate, and tri-2-ethylhexyl phosphate, respectively; and a lubricating oil composition comprising Base Oil A and Phosphorous Compound j.

The results are also shown in Table 3.

Next, a similar test was carried out to evaluate the effects when two phosphorous compounds of a given amount shown in Table 4 were added in combination.

The results are also shown in Table 4.

TABLE 3

| | Lubricating Oil Composition | | Wear |
|---|---|---|---|
| | Base Oil | Phosphorus Compound (Amount)* | Amount (mg) |
| Inventive Product Nos. | | | |
| 5 | A | a (0.25) | 3.2 |
| 6 | A | b (0.25) | 4.5 |
| 7 | A | c (0.25) | 4.3 |
| 8 | A | d (0.05) | 9.1 |
| 9 | A | d (0.1) | 4.1 |
| 10 | A | d (0.25) | 3.5 |
| 11 | A | d (0.5) | 1.7 |
| 12 | A | d (1.0) | 0.3 |
| 13 | B | d (0.25) | 5.6 |
| 14 | C | d (0.25) | 4.3 |
| 15 | D | d (0.25) | 4.0 |
| 16 | E | d (0.25) | 3.7 |
| 17 | F | d (0.25) | 4.7 |
| 18 | G | d (0.25) | 5.9 |
| 19 | H | d (0.25) | 6.5 |
| 20 | I | d (0.25) | 4.9 |
| 21 | A | e (0.25) | 4.4 |
| Comparative Product Nos. | | | |
| 6 | A | — | 16.3 |
| 7 | B | — | 20.2 |
| 8 | C | — | 19.8 |
| 9 | D | — | 18.2 |
| 10 | E | — | 18.7 |
| 11 | F | — | 25.1 |
| 12 | G | — | 29.8 |
| 13 | H | — | 26.3 |
| 14 | I | — | 26.7 |
| 15 | A | f (0.5) | 11.9 |
| 16 | A | g (0.5) | 13.2 |
| 17 | A | h (0.5) | 14.1 |
| 18 | B | f (0.5) | 15.4 |
| 19 | B | g (0.5) | 18.7 |
| 20 | B | h (0.5) | 17.9 |
| 21 | E | f (0.5) | 13.5 |
| 22 | E | g (0.5) | 18.2 |
| 23 | E | h (0.5) | 18.3 |
| 24 | A | j (0.5) | 11.5 |

Remark*: Amount based on 100 parts by weight of the base oil.

TABLE 4

| | Lubricating Oil Composition | | | Wear |
|---|---|---|---|---|
| | Base Oil | Phosphorus Compound (Amount)* | | Amount (mg) |
| Sample Nos. | | | | |
| i | A | g (0.5) | d (0.01) | 6.1 |
| ii | A | k (0.25) | d (0.01) | 6.9 |
| iii | A | g (0.25) | d (0.03) | 4.1 |
| iv | A | g (0.1) | d (0.05) | 5.3 |
| v | A | g (0.5) | d (0.03) | 3.2 |
| vi | A | g (0.02) | d (0.01) | 17.3 |
| vii | A | d (0.01) | | 17.1 |
| viii | A | g (0.5) | | 13.2 |
| ix | A | k (0.25) | | 14.9 |

Remark*: Amount based on 100 parts by weight of the base oil.

As shown in Table 3, the wear amount of Inventive Products 5 to 21 is notably smaller than those of Comparative Products 6 to 24, so that Inventive Products show remarkably superior properties in wear resistance.

In particular, Inventive Products show markedly excellent properties in wear resistance, as compared to cases of using a phosphorous compound having only one hydroxyl group without having a P—N bond (Comparative Products 15, 18, 21), or to a case of using the phosphorous compound having only one hydroxyl group and having a P—N bond (Comparative Product 24).

In addition, as shown in Table 4, in the case of Sample vii in which Phosphorous Compound d is used singly and thus in a small amount, the wear resistance of the resulting lubricating oil composition is poor, whereas in cases of Samples i and ii where Phosphorous Compound d is added in combination with Phosphorous Compound g or Phosphorous Compound k, the wear resistance of the resulting lubricating oil composition is remarkably improved. Since a notably poor performance in the wear resistance is observed in cases of Samples viii and ix where Compound g or Phosphorous Compound k is singly added in the same amount as that added in Samples i and ii without Phosphorous Compound d, it is made clear that synergistic effects in the wear resistance can be obtained by the combination of the phosphorous compounds. Incidentally, when the amount of Phosphorous Compound g added in combination is too small, as in the case of Sample vi, combined effects could not be observed.

Example 3

In order to evaluate wear resistance of Inventive Products, wear amount was measured using a high-pressure wear testing machine (manufactured by SHINKO ENGINEERING CO., LTD.).

In a testing vessel were charged 480 g of a lubricating oil composition and 240 g of 1,1,1,2-tetrafluoroethane, to prepare a working fluid composition for refrigerating machines, and the temperature inside the testing vessel was kept at 100° C. Vanes and disks were used as test pieces, and the wear amount of the vanes and disks after testing for six hours at 500 rpm while applying a load of 200 kg was measured.

The results are shown in Table 5.

TABLE 5

| | Lubricating Oil Composition | | Wear Amount of |
|---|---|---|---|
| | Base Oil | Phosphorus Compound (Amount)* | Disc and Vane (mg) |
| Inventive Product 22 | A | b (0.25) | 4.3 |
| Inventive Product 23 | A | d (0.1) | 3.6 |
| Inventive Product 24 | E | d (0.1) | 3.3 |
| Comparative Product 25 | A | — | 12.4 |
| Comparative Product 26 | A | g (0.5) | 7.5 |
| Comparative Product 27 | E | — | 6.9 |
| Comparative Product 28 | E | g (0.5) | 5.9 |

Remark*: Amount based on 100 parts by weight of the base oil.

As compared to Comparative Products, the working fluid compositions for refrigerating machines of the present invention have notably smaller wear amount, thereby showing superior properties in wear resistance.

Example 4

In order to evaluate the compatibility of Inventive Products with the hydrofluorocarbons, each of the lubricating oil compositions shown in Table 5 and 1,1,1,2-tetrafluoroethane was mixed in a weight ratio of 10/90 to 50/50 (lubricating oil composition/ 1,1,1,2-tetrafluoroethane). The two-phase separation temperature at a low temperature was measured.

The results are shown in Table 6.

TABLE 6

| | Lubricating Oil Composition | | Two-Phase Separation Temperature (° C.) | | | | |
|---|---|---|---|---|---|---|---|
| | Base Oil | Phosphorus Compound (Amount)* | 10% | 20% | 30% | 40% | 50% |
| Inventive Product 25 | A | a (0.25) | −18 | −17 | −16 | −19 | −20> |
| Inventive Product 26 | A | b (0.25) | −18 | −16 | −15 | −18 | −20> |
| Inventive Product 27 | A | d (0.25) | −18 | −16 | −15 | −18 | −20> |
| Inventive Product 28 | E | d (0.25) | −20> | −20> | −20> | −20> | −20> |
| Comparative Product 29 | J | — | 0< | 0< | 0< | 0< | 0< |

Remark*: Amount based on 100 parts by weight of the base oil.

It is clear from Table 6 that Inventive Products have excellent compatibility with the hydrofluorocarbons.

Example 5

In order to evaluate the thermal stability of Inventive Products, the sealed tube test was carried out under the following conditions.

Specifically, a glass tube was charged with 10 g of each of the lubricating oil compositions shown in Table 7 previously adjusted to have a water concentration of not more than 10 ppm and an acid value of not more than 0.03 mg KOH/g, and 5 g of 1,1,1,2-tetrafluoroethane. Iron, copper, and aluminum were added thereto as catalysts, and the glass tube was sealed. After the sealed glass tube was kept at 175° C. for 14 days, the corrosion of the metals (catalysts) was examined. The results are shown in Table 7.

TABLE 7

| | Lubricating Oil Composition | | |
|---|---|---|---|
| | Base Oil | Phosphorus Compound (Amount)* | Metal Corrosion |
| Inventive Product 29 | A | b (0.25) | Not Corroded |
| Inventive Product 30 | A | d (0.25) | Not Corroded |
| Inventive Product 31 | E | d (0.25) | Not Corroded |
| Comparative Product 30 | A | i (0.5) | Corroded |
| Comparative Product 31 | E | i (0.5) | Corroded |

Remark*: Amount based on 100 parts by weight of the base oil.

As shown in Table 7, Inventive Products show no corrosion against the metals, and thereby exhibiting excellent thermal stability.

Example 6

In order to evaluate wear resistance of Inventive Products, the compressor test was carried out using a rotary compressor.

Specifically, a 1 kW-rotary compressor ("G515QB1X," manufactured by Hitachi LTD.) was charged with 450 g of each of the lubricating oil compositions and 160 to 180 g of a mixed hydrofluorocarbon of difluoromethane/pentafluoroethane/1,1,1,2-tetrafluoroethane in a weight ratio of 23/25/52, to prepare a working fluid composition for refrigerating machines. The rotary compressor was continuously operated for 400 hours at a compressor shell top temperature of 130° C. under a discharge pressure of 26 kgf/cm$^2$ and a suction pressure of 5 kgf/cm$^2$. After running the test, the wear amount at the tip end of the vane was measured.

The results are shown in Table 8.

TABLE 8

| | Lubricating Oil Composition | | | |
|---|---|---|---|---|
| | Base Oil | Phosphorus Compound (Amount)* | | Wear Amount of Vane ($\mu$m) |
| Inventive Product 32 | A | d (0.2) | | 5.9 |
| Inventive Product 33 | A | d (0.4) | | 7.5 |
| Inventive Product 34 | A | d (0.02) | g (0.48) | 3.2 |
| Inventive Product 35 | A | d (0.04) | g (0.45) | 3.1 |
| Inventive Product 36 | A | d (0.07) | g (0.40) | 3.8 |
| Comparative Product 32 | A | — | | 32.5 |
| Comparative Product 33 | A | g (0.5) | | 29.9 |

Remark*: Amount based on 100 parts by weight of the base oil.

As shown in Table 8, the working fluid compositions for refrigerating machines of Inventive Products have smaller wear amount, as compared to those of Comparative Products, and thereby showing excellent wear resistance.

According to the present invention, there can be provided a lubricating oil composition having excellent lubricity, particularly when using a base oil having a high polarity, excellent compatibility with the hydrofluorocarbons, and substantially no corrosion against metal surfaces, and a working fluid composition for refrigerating machines including the lubricating oil composition.

The present invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A lubricating oil composition comprising a phosphorous compound having two or more hydroxyl groups and a P—N bond in a molecule (simply abbreviated as "First Phosphorous Compound"), and one or more phosphorus compounds (simply abbreviated as "Second Phosphorus Compound") wherein, said First Phosphorous Compound is represented by the general formula (1) or (2):

(1)

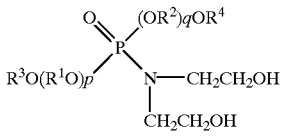

(2)

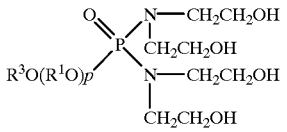

wherein $R^1$ and $R^2$, which may be identical or different, each represents a linear or branched alkylene group having 2 to 4 carbon atoms; p and q are from 0 to 30; and $R^3$ and $R^4$, which may be identical or different, each represents a hydrogen atom; a linear alkyl group having 1 to 30 carbon atoms; a branched alkyl group having 3 to 30 carbon atoms; a linear alkenyl group having 2 to 30 carbon atoms; a branched alkenyl group having 3 to 30 carbon atoms; an aryl group having 6 to 30 carbon atoms; an aralkyl group having 7 to 30 carbon atoms; a halogenated alkyl group having 1 to 30 carbon atoms; or a halogenated aryl group having 6 to 30 carbon atoms, provided that when p is 0, $R^3$ is not a hydrogen atom, or when q is 0, $R^4$ is not hydrogen atom; and said Second Phosphorous Compound is selected from the group consisting of compounds represented by the general formula (3)

(3)

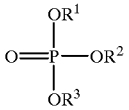

wherein $R^1$ to $R^5$ and $R^7$ to $R^9$, which may be identical or different, each represents an aryl group having 6 to 18 carbon atoms; a linear alkyl group having 1 to 18 carbon atoms; a branched alkyl group having 3 to 18 carbon atoms; a linear alkenyl group having 2 to 18 carbon atoms; or a branched alkenyl group having 3 to 18 carbon atoms; and $R^6$ represents a hydrogen atom; a linear alkyl group having 1 to 18 carbon atoms; a branched alkyl group having 3 to 18 carbon atoms; a linear alkenyl group having 2 to 18 carbon atoms; or a branched alkenyl group having 3 to 18 carbon atoms; and wherein said lubricating oil composition comprises, based on 100 parts by weight of a lubricating base oil, 0.001 to 5.0 parts by weight of said First Phosphorus Compound and 0.1 to 5.0 parts by weight of said Second Phosphorus Compound.

2. The lubricating oil composition according to claim 1, wherein said First Phosphorus Compound has two to four hydroxyl groups in a molecule, and further one P—N bond or two P—N bonds in which two nitrogen atoms are bonded to one phosphorus atom.

3. The lubricating oil composition according to claim 1, wherein, in said general formula (1) or (2), said p and q are 0, and said $R^3$ and $R^4$, which may be identical or different, each represents a linear alkyl group having 1 to 30 carbon atoms; a branched alkyl group having 3 to 30 carbon atoms; an aryl group having 6 to 30 carbon atoms; or an aralkyl group having 7 to 30 carbon atoms.

4. The lubricating oil composition according to claim 1, wherein said lubricating oil composition comprises, based on 100 parts by weight of the lubricating base oil, 0.001 to 1.0 part by weight of said First Phosphorus Compound and 0.03 to 5.0 parts by weight of said Second Phosphorus Compound.

5. The lubricating oil composition according to claim 1, wherein said lubricating base oil comprises one or more compounds selected from the group consisting of esters, cyclic ketals, cyclic acetals, polyethers, polyalkylene glycols, and carbonates.

6. A working fluid composition for a refrigerating machine comprising the lubricating oil composition according to claim 1, 2, 4, or 5, and a hydrofluorocarbon.

7. A working fluid composition for a refrigerating machine comprising a lubricating oil composition comprising a First Phosphorus Compound as defined in claim 1 and a hydrofluorocarbon.

8. The working fluid composition for a refrigerating machine according to claim 7, wherein said First Phosphorus Compound has two to four hydroxyl groups in a molecule, and further one P—N bond or two P—N bonds in which two nitrogen atoms are bonded to one phosphorus atom.

9. The working fluid composition for a refrigerating machine according to claim 7, wherein, in said general formula (1) or (2), said p and q are 0, and said $^3$ and $R^4$, which may be identical or different, each represents a linear alkyl group having 1 to 30 carbon atoms; a branched alkyl group having 3 to 30 carbon atoms; an aryl group having 6 to 30 carbon atoms; or an aralkyl group having 7 to 30 carbon atoms.

10. The working fluid composition for a refrigerating machine according to claim 7, wherein said lubricating oil composition comprises 0.03 to 5.0 parts by weight of said First Phosphorus Compound, based on 100 parts by weight of a lubricating base oil.

11. The working fluid composition for a refrigerating machine according to claim 7, wherein the mixing ratio of said hydrofluorocarbon to said lubricating oil composition is 50/1 to 1/20 by weight.

12. A working fluid composition for a refrigerating machine comprising a lubricating oil composition as defined in claim 1 and a hydrofluorocarbon.

* * * * *